US006421852B1

(12) United States Patent
Shao

(10) Patent No.: US 6,421,852 B1
(45) Date of Patent: Jul. 23, 2002

(54) PORTABLE SLEEPING BAG ARRANGEMENT

(76) Inventor: Dan Shao, 1826 Chantry Dr., Arcadia, CA (US) 91006

( * ) Notice: Subject to any disclaimer, the term of this patent is extended or adjusted under 35 U.S.C. 154(b) by 0 days.

(21) Appl. No.: 09/625,211

(22) Filed: Jul. 24, 2000

(51) Int. Cl.[7] ..... A47G 9/04; A63H 3/02
(52) U.S. Cl. ..... 5/413 R; 446/73; D2/719
(58) Field of Search ..... 5/413 R, 413 AM, 5/482, 502; 446/73; D2/718, 719; 2/69, 69.5

(56) References Cited

U.S. PATENT DOCUMENTS 4,587,682 A * 5/1986 Schultz ..... 5/413 R
4,590,633 A * 5/1986 Pickens ..... 5/413 R
4,734,948 A * 4/1988 Danova ..... 5/502
4,739,529 A * 4/1988 Mills ..... 5/413 R
4,754,512 A * 7/1988 Chao-Yang ..... 5/482
4,774,734 A * 10/1988 Mills ..... 5/413 R
5,084,930 A * 2/1992 Danova ..... 5/502

* cited by examiner

*Primary Examiner*—Alexander Grosz
(74) *Attorney, Agent, or Firm*—Raymond Y. Chan; David and Raymond Patent Group

(57) ABSTRACT

A portable sleeping bag includes a carrier having an appearance of a doll having a receiving cavity for storing a sleeping bag therein, wherein a top edge of the sleeping bag is detachably fastened to a bottom portion of the receiving cavity, so that when the sleeping bag is fully unfolded from the carrier, the carrier still functions as the favor toy of the child user to provide a warm relationship of childish for the young child.

15 Claims, 6 Drawing Sheets

PORTABLE SLEEPING BAG ARRANGEMENT

BACKGROUND OF THE PRESENT INVENTION

1. Field of Invention

The present invention relates to a sleeping bag, and more particularly to a portable sleeping bag arrangement comprising a sleeping bag contained within an animal figure backpack which is designed to be easy for young children of nursery school or kindergarten to carry and store and moreover, intends to create a comfortable and secure sleeping environment for the children with its warn and inviting appearance.

2. Description of Related Arts

Conventional sleeping bags are generally over-sized and difficult to carry, as the sheet materials of which they are made can be awkward when it is folded and rolled. While adults are capable of handling the size and weight of the conventional sleeping bags, children usually have difficulty doing so. The present invention specifically addresses this difficulty.

Furthermore, the reality is that most young children are active and are not easily convinced of going to bed. Bedtime toys generally encourage children to sleep. However, in most situations that require children to bring sleeping bags, it is virtually impossible for those children to carry both their sleeping bags and their toys at the same time.

SUMMARY OF THE PRESENT INVENTION

A main object of the present invention is to provide a portable sleeping bag arrangement which comprises an easy-to-use, portable sleeping bag contained within a friendly carrier that not only serves as an animal figure container of the sleeping bag, but also acts as an animal toy, so that the children can carry their sleeping bags and favorite toys at the same time, allowing them to do both efficiently and comfortably and transforming the carrier into a sleep-encouraging companion when necessary.

Another object of the present invention is to provide a portable sleeping bag arrangement, which enables the child to sleep on his or her sleeping bag with a favorite animal figure carrier attached thereto so as to encourage the child to feel secure and comfortable in his or her setting as it fosters a relationship of warmth and friendship between toy and child.

Another object of the present invention is to provide children with a portable sleeping bag arrangement, which is suited to their needs and will be relatively easy for them to carry and to store.

Another object of the present invention is to provide a portable sleeping bag which can be entirely contained and concealed within a carrier that has a back pack structure and can be easily transported as necessary.

Accordingly, in order to accomplish the above objects, the present invention provides a portable sleeping bag arrangement, which comprises:

- a sleeping bag comprising a back layer providing a sleeping surface and a cover layer overlappingly positioned on the back layer;
- means for detachably connecting the back layer with the cover layer to form a bag body; and
- a carrier, which comprises an animal figure container constructed as an animal figure, having a receiving cavity provided therein and an opening provided on a front body surface of the animal figure container, and wherein the receiving cavity has a size adapted to entirely receive the sleeping bag therein via the opening.

The portable sleeping bag arrangement of the present invention further comprises a first fastening element affixed on a top side of the back layer and a second fastening element affixed to a predetermined portion of the receiving cavity, wherein the first fastening element is detachably connected to the second fastening element for attaching the sleeping bag with the carrier even though the sleep bag is unfolded out from the carrier via the opening.

The carrier of portable sleeping bag arrangement of the present invention further comprises a pair of shoulder straps parallelly provided on two sides of the front body surface of the animal figure container so that user can carry it on his or her back.

DETAILED DESCRIPTION OF THE PREFERRED EMBODIMENT

Figure 1:
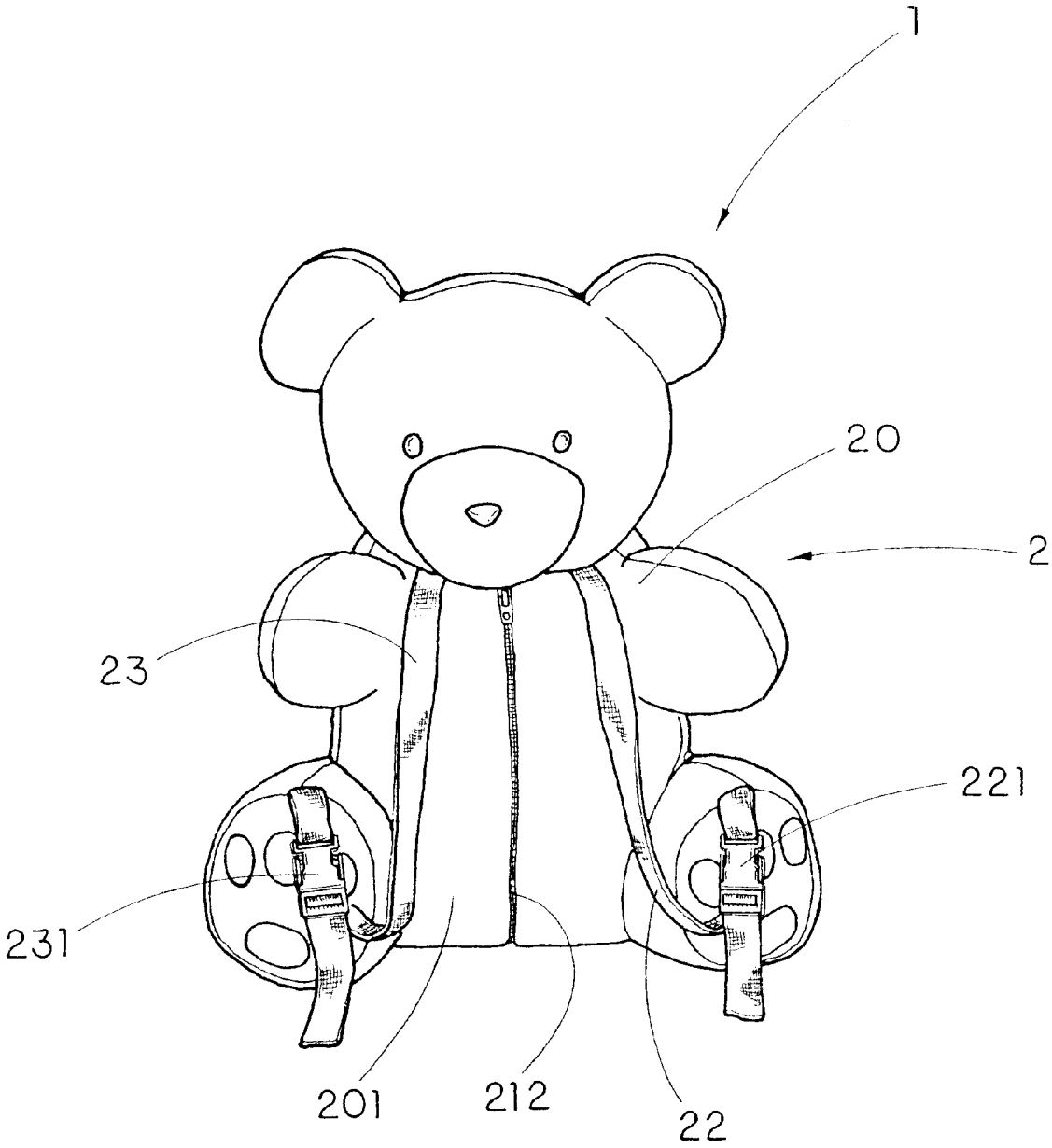
FIG. 1 is a perspective view of a portable sleeping bag arrangement according to a preferred embodiment of the present invention.

Referring to FIGS. 1 to 4 of the drawings, a portable sleeping bag arrangement 1 according to a preferred embodiment of the present invention is illustrated, which comprises a sleeping bag 10 detachably attached to a carrier 2.

The sleeping bag 10 comprises a back layer 11 providing a sleeping surface and a cover layer 12 extended from the back layer 11 to overlappingly position on the back layer 11 or remaining expanded to form a double-size sleeping surface.

Figure 2:
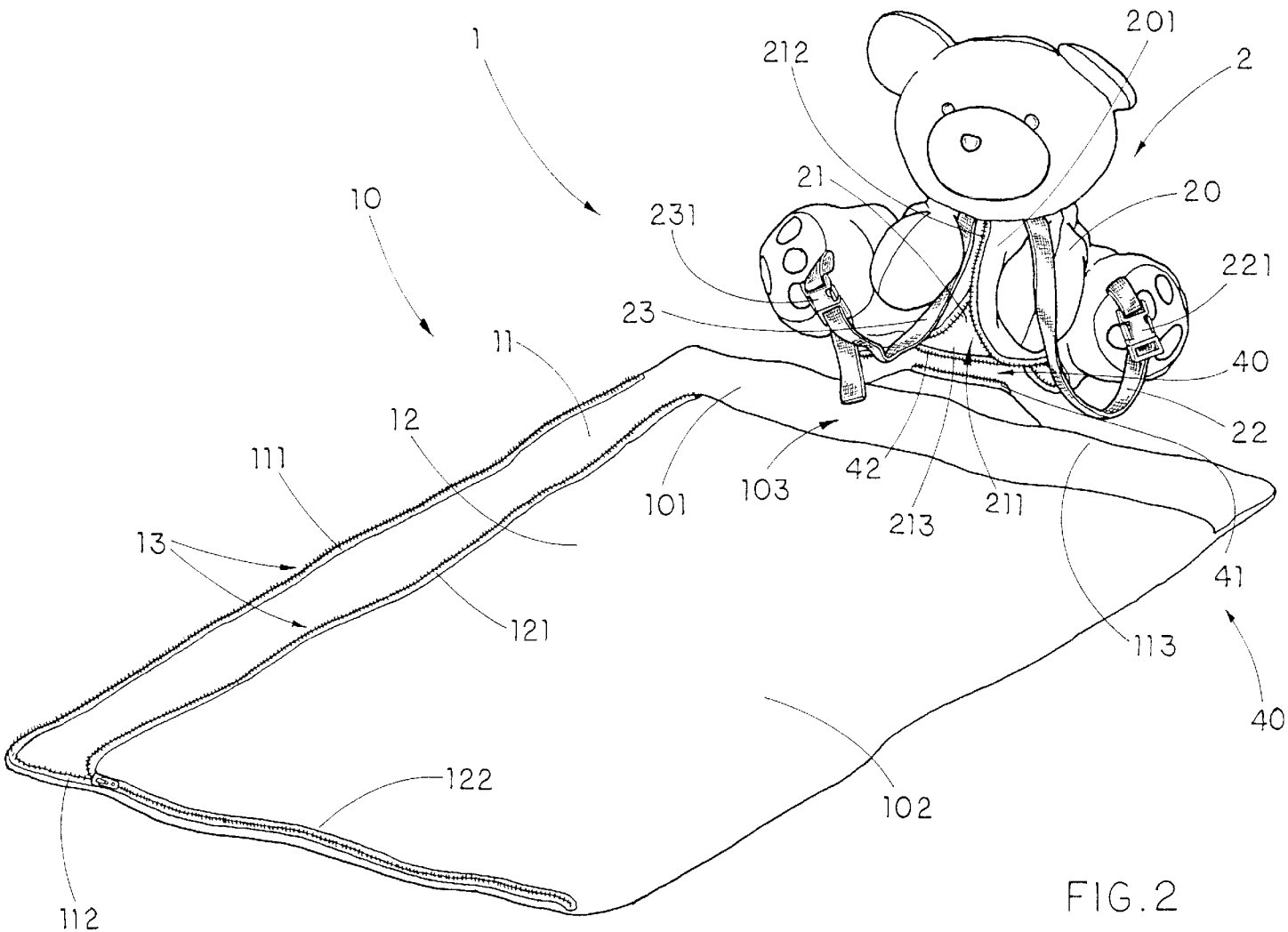
FIG. 2 is a perspective view of the portable sleeping bag arrangement according to the above preferred embodiment of the present invention, illustrating the sleeping bag detached from the carrier.
Figure 3:
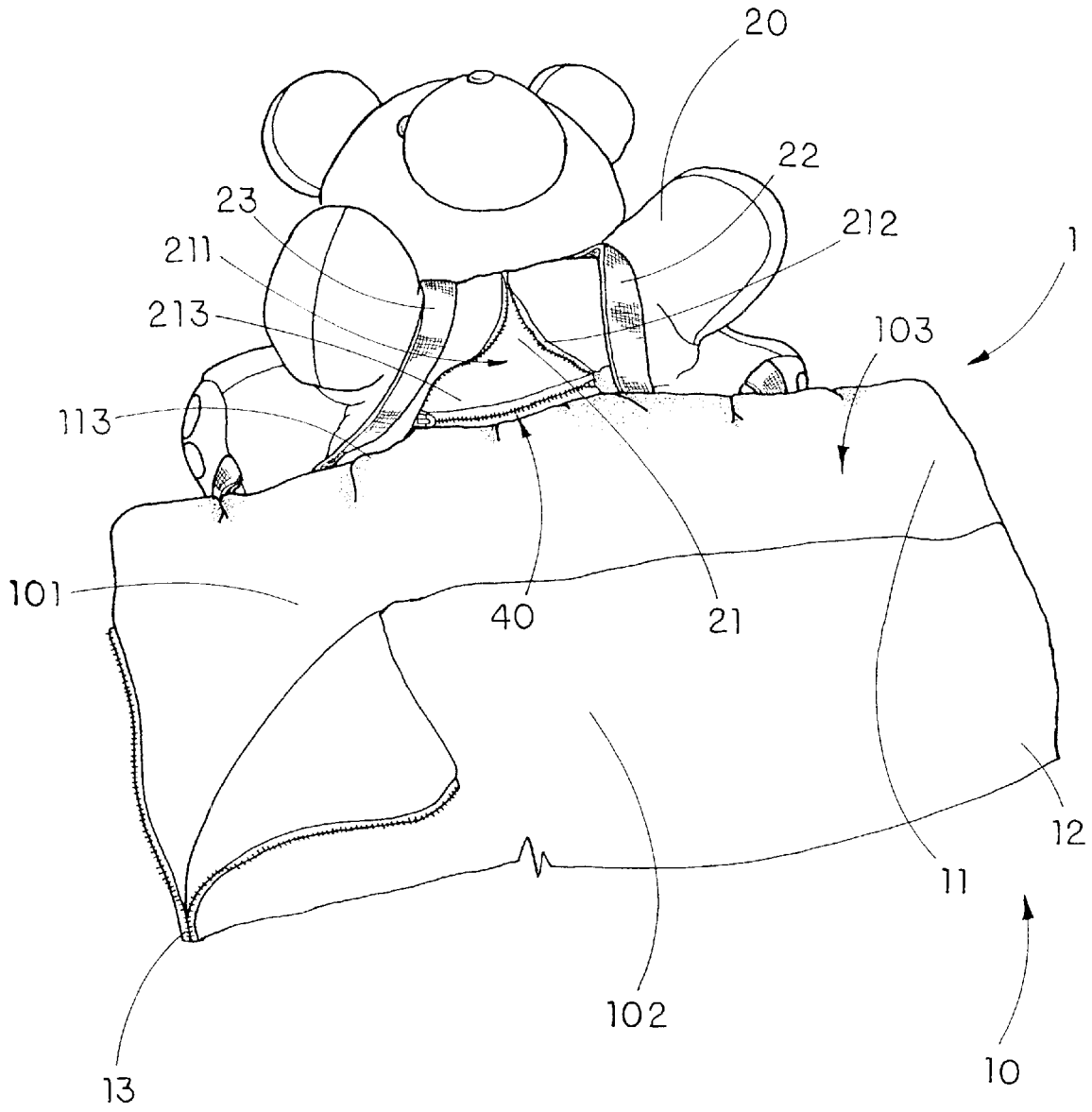
FIG. 3 is a perspective view of the portable sleeping bag arrangement according to the above preferred embodiment of the present invention, illustrating the sleeping bag attached to the carrier.

The carrier 2 comprises an animal figure container 20, as shown in FIGS. 2 and 3, constructed as an animal figure, having a receiving cavity 21 provided therein and an opening 211 provided on a front body surface 201 of the animal figure container 21, and a fastening means 212 for closing the opening 211 of the animal figure container 21, wherein the receiving cavity 21 has a size adapted to receive the entire sleeping bag 10 therein via the opening 211.

The sleeping bag 10 is made of a sheet material, which is adapted to provide waterproof, ventilating, and insulating effects, wherein one half of the sheet material is folded up to overlap on the other half of the sheet material to form the cover layer 12 and the back layer 11 respectively.

The sleeping bag 10 comprises an inner cover 101 and an outer cover 102 sewed to or sealedly bonded to the inner cover 101, wherein the inner cover 101 is made of flexible and stretchable fabric that should be non-irritant, comfortable, such as cotton or the like, since the inner cover 101 provides a soft surface in contact with the young child's body. The outer cover 102 of the sheet material 10 should be durable and washable since the outer cover 102 is exposed to surroundings and protects the inner cover 101. So, the outer cover 102 should last for a long time and preferable be made of nylon or other commonly known materials.

The portable sleeping bag arrangement 1 further comprises a connector 13 for detachably connecting the back layer 11 with the cover layer 12 to form a bag body. As shown in FIG. 2, the connector 13 is an elongated zipper affixed along side edges 111, 121 and bottom edges 112, 122 of the back layer 11 and the cover layer 12 respectively, so as to attach the side edges 111, 121 and the bottom edges 112, 122 of the back layer 11 and the cover layer 12 together to form a bag body having a top opening 103.

The carrier 2 can be constructed in form of a popular animal or cartoon appearance such as "Terry Bear", that the young child prefers, in order to foster a warm relationship between toy and child, so that the child will be encouraged to use the portable sleeping bag arrangement 1 and to sleep. The carrier 2 can be made of soft material such as cotton in order to provide a comfortable sleeping surface for the young children. So, the young child is able to hug and play with the carrier 2 as he or she would with a normal doll when the sleeping bag 10 is not in use and is stored in the receiving cavity 21 of the animal figure container 20.

Furthermore, the receiving cavity 21 of the carrier 2 is adapted to store the entire sleeping bag 10 therein. In order to close up the opening 211 when the sleeping bag 10 is not in use and stored inside the receiving cavity 21 of the carrier 2, the carrier 2 further comprises the fastening means 212 which is a zipper stitched along two sides of the opening 211.

The portable sleeping bag arrangement 1 of the present invention further comprises a fastener 40 for connecting a top edge 113 of the back layer 11 to a bottom portion 213 of the receiving cavity 21 of the animal figure container 20.

Figure 4:
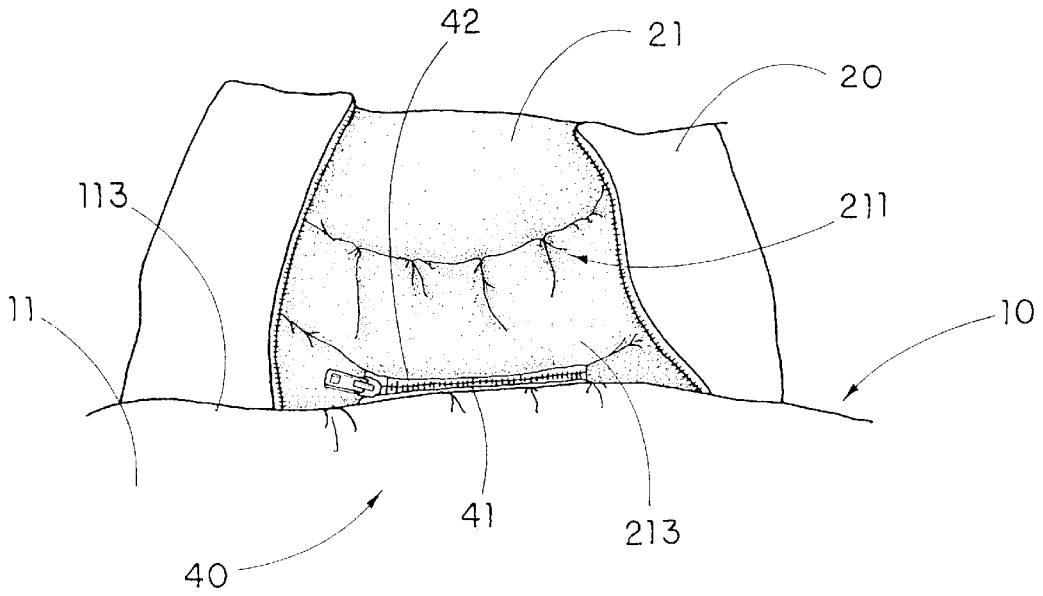
FIG. 4 is a partial perspective view of the portable sleeping bag arrangement according to the above preferred embodiment of the present invention, illustrating how the sleeping bag can be connected with the carrier by securing the first fastening element with the second fastening element.

According to the preferred embodiment of the present invention, as shown in FIGS. 2 to 4, the fastener 40 comprises a first fastening element 41 affixed on the top side 113 of the back layer 11 and a second fastening element 42 affixed to a bottom portion 213 of the receiving cavity 21, wherein the first fastening element 41 is detachably connected to the second fastening element 42 SO that the sleeping bag 10 can be attached to the carrier 2 even though the sleep bag 10 is unfolded out from the carrier 2 via the opening 211.

The fastener 40 of the portable sleeping bag arrangement 1 can be a zipper where the first and second fastening elements 41 and 42 of the fastener 40 are two halves of the zipper. The first fastening element 41 is firmly stitched to the top edge 113 of the back layer 11 of the sleeping bag 10 and the second fastening element 42 is stitched to the bottom portion 213 of the receiving cavity 21. Normally, the sleeping bag 10 is attached to the carrier 2, so as to prevent the carrier 2 from being accidentally lost.

Figure 6:
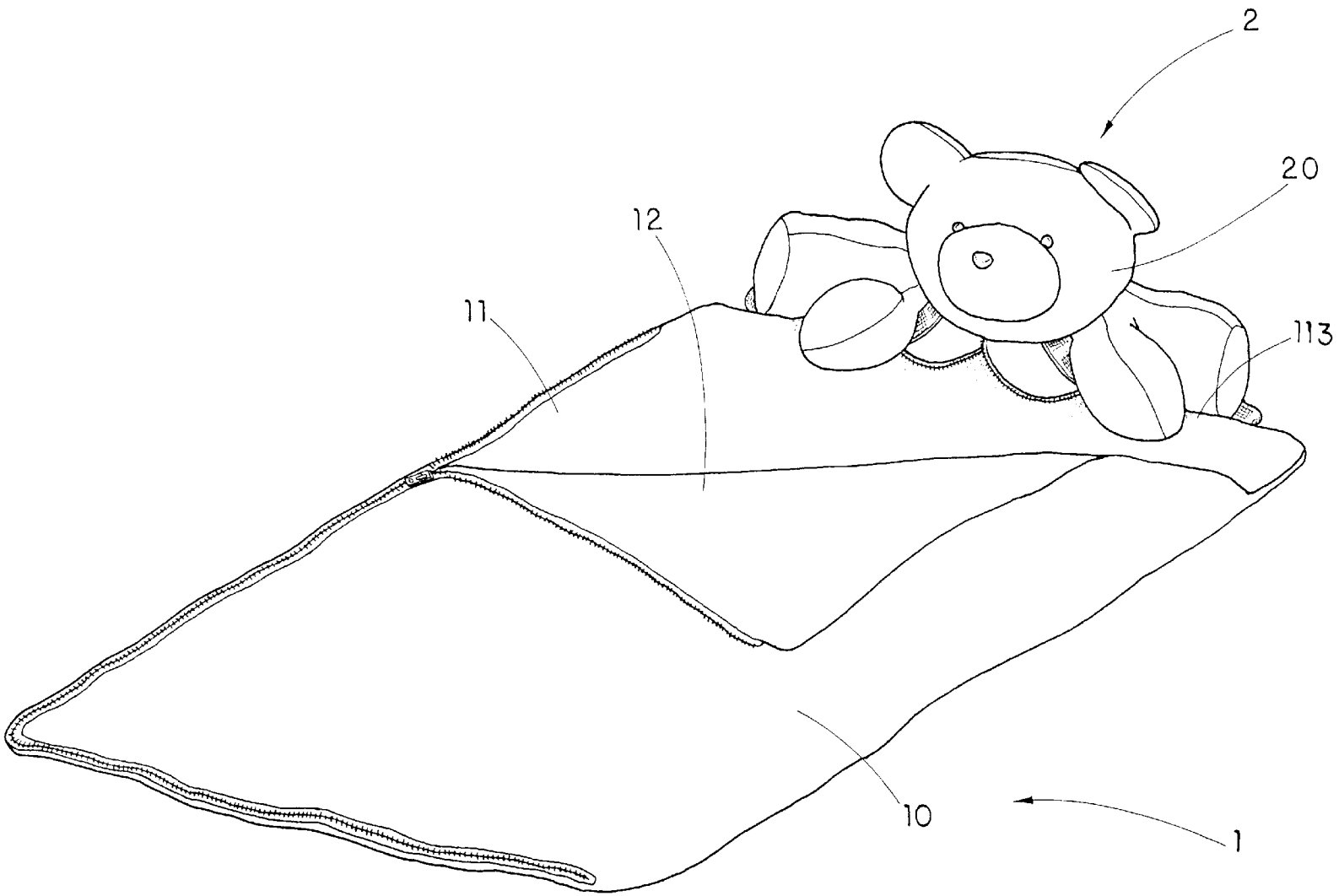
FIG. 6 is a perspective view of the portable sleeping bag arrangement while the sleeping bag is fully unfolded from the carrier, according to the above preferred embodiment of the present invention.
Figure 7:
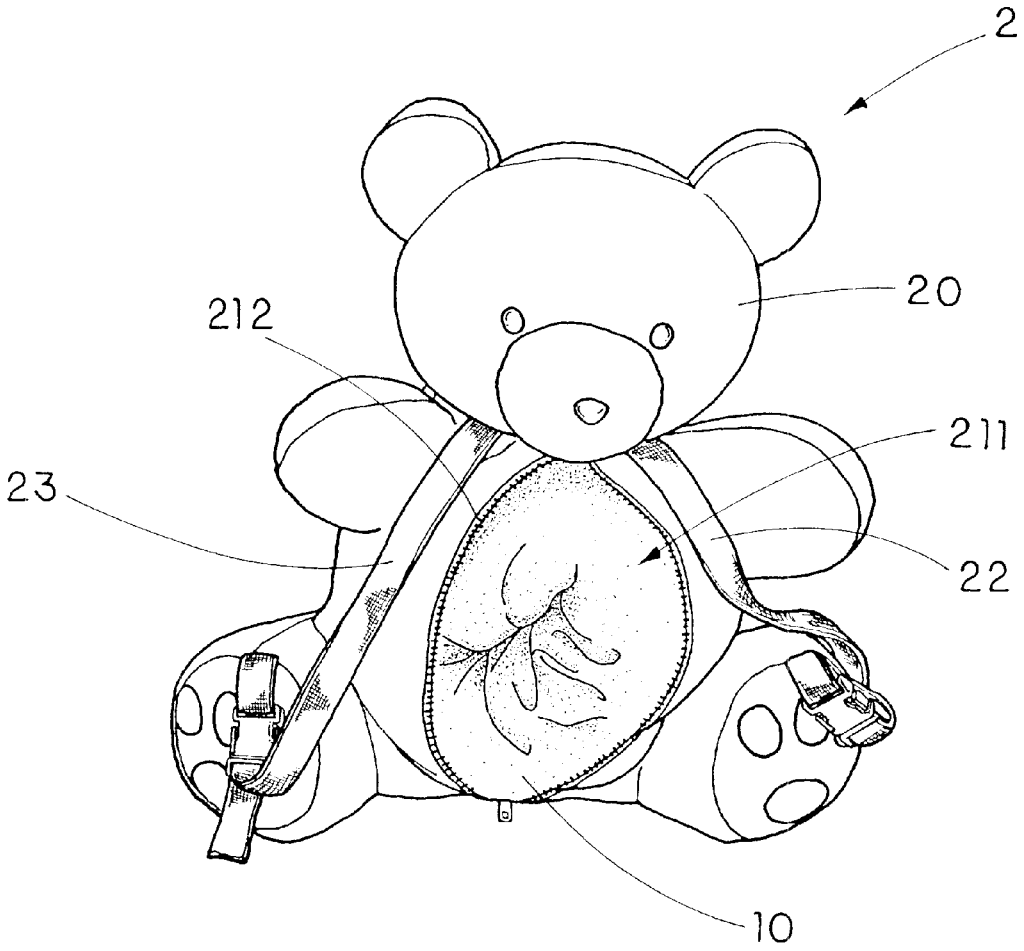
FIG. 7 is a perspective view of the portable sleeping bag arrangement while the sleeping bag is being inserted into the carrier, according to the above preferred embodiment of the present invention.

Moreover, as shown in FIG. 6, when the sleeping bag 10 is fully unfolded, the animal figure container 20 sits at the top portion of the sleeping bag 10 since the animal figure container 20 can still be connected to the top edge 113 of the back layer 11 of the sleeping bag 10 by means of the fastener 40. In other words, the child's favored animal toy sits at the head of his or her "be" and provides a warmth and friendship that will encourage the child to feel secure and comfortable in his or her setting. The child user may also use the animal figure container 20 as the pillow. As shown in FIG. 7, when the sleeping bag 10 is not use, the child can fold it up and insert it into the receiving cavity 21 through the opening 211 of the animal figure container 20.

Figure 5:
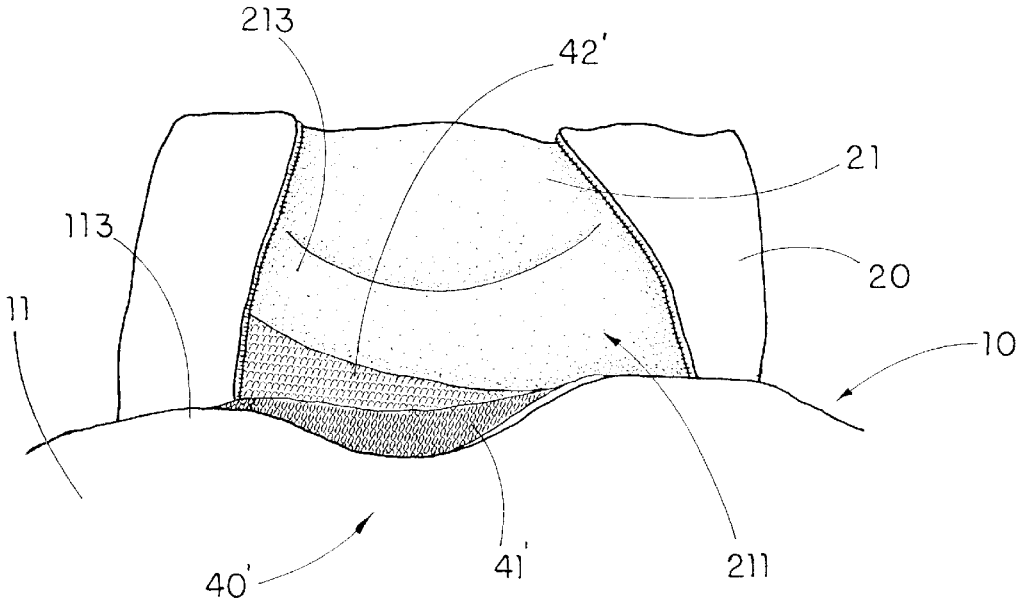
FIG. 5 is another partial perspective view the portable sleeping bag arrangement according to the above preferred embodiment of the present invention, illustrating an alternative mode of the first and second fastening elements.

Alternatively, as shown in FIG. 5, the fastener 40' is a set of hook and loop fasteners, wherein the first fastening element 41' is a loop fastener pad stitched on the top edge 113 of the back layer 11 of the sleeping bag 10 and the second fastening element 42' is a hook fastener pad affixed to the bottom portion 213 of the receiving cavity 21 of the animal figure container 20, so that the sleeping bag 10 can be rapidly attached to or detached from the animal figure container 20 of the carrier 2.

The carrier of portable sleeping bag arrangement of the present invention further comprises a pair of shoulder straps 22, 23 parallelly provided on two sides of the front body surface of the animal figure container 20 for placement on the young child's back. The two ends of each of the shoulder straps 22, 23 are firmly stitched to an upper and a lower position of the animal figure container 20 respectively. Each shoulder strap 22, 23 further comprises an adjusting joint 221, 231 for adjusting the length of the shoulder strap 22, 23 in order to fit each child.

In view of the above preferred embodiment and its alternative modes, when the sleeping bag 10 is not used and stored in the receiving cavity 21 of the carrier 2, the portable sleeping bag arrangement 1 provides the child with an amusing and friendly carrier 2 (that acts as a stuffed toy) with which the child can play. Also, when the young child has to go to bed, the carrier 2, with its comforting and warm presence, encourages the child to sleep and soothes his or her restlessness. Moreover, the portable sleeping bag arrangement 1 provides the pair of straps 22, 23, which allows the young child to easily carry the bag and furthermore, bring his or her stuffed toy.

What is claimed is:

1. A portable sleeping bag arrangement, comprising:

a sleeping bag comprising a back layer providing a sleeping surface and a cover layer overlappingly positioned on said back layer;

a carrier, which comprises an animal figure container having a receiving cavity provided therein and an opening vertically provided and extended on a front body surface of said animal figure container, and a fastening means for closing said opening of said animal figure container, wherein said receiving cavity has a size adapted to receive said sleeping bag therein via said opening; and a fastener comprising a first fastening element affixed on said top side of said back layer and a second fastening element affixed to a bottom portion inside said receiving cavity of said animal figure container, wherein said first fastening element is detachably connected to said second fastening element for attaching said sleeping bag with said carrier when said sleep bag is folded inside said receiving cavity and unfolded out from said carrier via said opening.

2. A portable sleeping bag arrangement, as recited in claim 1, wherein said fastener of said portable sleeping bag arrangement is a zipper where said first and second fastening elements of said fastener are two halves of said zipper.

3. A portable sleeping bag arrangement, as recited in claim 2, further comprising a connector for detachably connecting said back layer with said cover layer to form a bag body, wherein said connector is affixed along at least side edges of said back layer and said cover layer respectively, so as to attach said side edges and said bottom edges of said back layer and said cover layer together to form a bag body having a top opening.

4. A portable sleeping bag arrangement, as recited in claim 3, wherein said connector is a zipper.

5. A portable sleeping bag arrangement, as recited in claim 4, wherein said carrier further comprises a pair of shoulder straps parallelly provided on two sides of said front body surface of said animal figure container, wherein two ends of each of said shoulder straps are firmly stitched to an upper and a lower position of said animal figure container respectively, and each of said shoulder straps further comprises an adjusting joint for adjusting a length of each of said shoulder straps.

6. A portable sleeping bag arrangement, as recited in claim 3, wherein said carrier further comprises a pair of shoulder straps parallelly provided on two sides of said front body surface of said animal figure container, wherein two ends of each of said shoulder straps are firmly stitched to an upper and a lower position of said animal figure container respectively, and each of said shoulder straps further comprises an adjusting joint for adjusting a length of each of said shoulder straps.

7. A portable sleeping bag arrangement, as recited in claim 1, wherein said fastener is a set of hook and loop fasteners, wherein said first fastening element is a loop fastener pad stitched on said top edge of said back layer of said sleeping bag and said second fastening element is a hook fastener pad affixed to said bottom portion of said receiving cavity of said animal figure container.

8. A portable sleeping bag arrangement, as recited in claim 7, further comprising a connector for detachably connecting said back layer with said cover layer to form a bag body, wherein said connector is affixed along at least side edges of said back layer and said cover layer respectively, so as to attach said side edges and said bottom edges of said back layer and said cover layer together to form a bag body having a top opening.

9. A portable sleeping bag arrangement, as recited in claim 8, wherein said connector is a zipper.

10. A portable sleeping bag arrangement, as recited in claim 9, wherein said carrier further comprises a pair of shoulder straps parallelly provided on two sides of said front body surface of said animal figure container, wherein two ends of each of said shoulder straps are firmly stitched to an upper and a lower position of said animal figure container respectively, and each of said shoulder straps further comprises an adjusting joint for adjusting a length of each of said shoulder straps.

11. A portable sleeping bag arrangement, as recited in claim 8, wherein said carrier further comprises a pair of shoulder straps parallelly provided on two sides of said front body surface of said animal figure container, wherein two ends of each of said shoulder straps are firmly stitched to an upper and a lower position of said animal figure container respectively, and each of said shoulder straps further comprises an adjusting joint for adjusting a length of each of said shoulder straps.

12. A portable sleeping bag arrangement, as recited in claim 1, further comprising a connector for detachably connecting said back layer with said cover layer to form a bag body, wherein said connector is affixed along at least side edges of said back layer and said cover layer respectively, so as to attach said side edges and said bottom edges of said back layer and said cover layer together to form a bag body having a top opening.

13. A portable sleeping bag arrangement, as recited in claim 12, wherein said connector is a zipper.

14. A portable sleeping bag arrangement, as recited in claim 12, wherein said carrier further comprises a pair of shoulder straps parallelly provided on two sides of said front body surface of said animal figure container, wherein two ends of each of said shoulder straps are firmly stitched to an upper and a lower position of said animal figure container respectively, and each of said shoulder straps further comprises an adjusting joint for adjusting a length of each of said shoulder straps.

15. A portable sleeping bag arrangement, as recited in claim 13, wherein said carrier further comprises a pair of shoulder straps parallelly provided on two sides of said front body surface of said animal figure container, wherein two ends of each of said shoulder straps are firmly stitched to an upper and a lower position of said animal figure container respectively, and each of said shoulder straps further comprises an adjusting joint for adjusting a length of each of said shoulder straps.

* * * * *